US011236936B1

(12) United States Patent
Nam et al.

(10) Patent No.: US 11,236,936 B1
(45) Date of Patent: Feb. 1, 2022

(54) BLACK ICE GENERATING DEVICE FOR GENERATING BLACK ICE ON A SPECIMEN TO BE USED FOR EXPERIMENTS ON BLACK ICE

(71) Applicant: National Institute of Meteorological Sciences, Seogwipo-si (KR)

(72) Inventors: Hyoung Gu Nam, Gangneung-si (KR); Mi Eun Park, Gangneung-si (KR); Baek Jo Kim, Gangneung-si (KR)

(73) Assignee: NATIONAL INSTITUTE OF METEOROLOGICAL SCIENCES

( * ) Notice: Subject to any disclaimer, the term of this patent is extended or adjusted under 35 U.S.C. 154(b) by 0 days.

(21) Appl. No.: 17/407,089

(22) Filed: Aug. 19, 2021

(30) Foreign Application Priority Data

Nov. 30, 2020 (KR) ..... 10-2020-0164728

(51) Int. Cl.
*F25C 1/22* (2018.01)

(52) U.S. Cl.
CPC ..... *F25C 1/22* (2013.01)

(58) Field of Classification Search
CPC ..... F25C 1/24; F25C 3/00; F25C 1/22; A23G 9/083
See application file for complete search history.

(56) References Cited

U.S. PATENT DOCUMENTS 2,256,973 A * 9/1941 Doherty ..... F25C 1/22 249/52
2015/0219390 A1* 8/2015 Luther ..... F25D 3/06 222/146.6
2019/0170626 A1 6/2019 Kravtsov et al.

FOREIGN PATENT DOCUMENTS

KR 102182000 11/2020
KR 1020200139621 12/2020

* cited by examiner

*Primary Examiner* — Cassey D Bauer
(74) *Attorney, Agent, or Firm* — David R. Stevens; Stevens Law Group

(57) ABSTRACT

A black ice generating device for generating black ice on a specimen, with dimensions of length X, width Y, and height Z, to be used for experiments on black ice, comprising: a housing; a specimen loading part, for accommodating at least a height h of a water layer, wherein the specimen loading part is formed in the housing and configured as a depression with dimensions of at least length X, at least width Y, and at least height Z+h; and one or more strap loading parts formed with recesses of a depth D1 and a depth D2 respectively from a first side surface of the depression and a second side surface thereof, wherein the recesses are to accommodate one or more straps, and wherein the depth D1 and the depth D2 are larger than a size of a cross-section of the straps.

9 Claims, 5 Drawing Sheets

BLACK ICE GENERATING DEVICE FOR GENERATING BLACK ICE ON A SPECIMEN TO BE USED FOR EXPERIMENTS ON BLACK ICE

CROSS REFERENCE TO RELATED APPLICATION

This patent application claims the benefit and priority of Korean Patent Application No. KR 10-2020-0164728 filed on Nov. 30, 2020, the disclosure of which is incorporated by reference herein in its entirety as part of the present application.

FIELD OF THE DISCLOSURE

The present disclosure relates to a black ice generating device on a specimen to be used for experiments on black ice.

BACKGROUND OF THE DISCLOSURE

Clear ice formation on roads during winter, also known as black ice, is considered a major cause of traffic accidents during winter because identifying the black ice from black asphalt roads can be difficult for drivers; also, the black ice can greatly increase the braking distance of a vehicle due to a reduction of a friction of the roads. This may cause not only social and economic issues, but also causalities.

As part of countermeasures against such black ice, observations and experiments are carried out to understand meteorological conditions in which the black ice occurs. In order to reproduce the meteorological conditions in which the black ice occurs, a temperature of a specimen used in experiments and a height of a water layer to be loaded onto the specimen should be appropriately controlled.

However, unlike actual asphalt roads that have been compacted due to vehicles driving thereon, asphalt material used as the specimen for the experiments of generating the black ice thereon is not adequate for use in reproducing the necessary meteorological conditions in which the black ice occurs because water simply permeates through the specimen. Additionally, a waterproofing process has to take place in order to allow the height the water layer to be maintained, therefore, considerable time and labor are required, prior to starting the experiments.

On account of the reasons above, there is a need for a black ice generating device capable of reducing the time and the labor consumed prior to the experiments and reproducing the meteorological conditions effortlessly in which the black ice occurs.

SUMMARY OF THE DISCLOSURE

It is an object of the present disclosure to solve all of the aforementioned problems.

It is another object of the present disclosure to greatly reduce time and labor consumed when generating black ice.

It is still another object of the present disclosure to provide a black ice generating device with a specimen loading part, configured as a depression in a housing, and one or more strap loading parts, configured as recesses for loading one or more straps.

It is still yet another object of the present disclosure to allow a height of a water layer to be recognized and allow a degree of minute adjustment therefrom to be recognized by coating thermochromic dye, whose color is varied according to a temperature of a water layer, and graduating at least part of a first side surface and a second side surface of the depression.

In accordance to one aspect of the present disclosure, there is provided a black ice generating device for generating black ice on a specimen, with dimensions of length X, width Y, and height Z, to be used for experiments on black ice, including: a housing; a specimen loading part, made to be waterproof, for accommodating at least a height h of a water layer to be used for generating the black ice therein, wherein the specimen loading part is configured as a depression with dimensions of at least length X, at least width Y, and at least height Z+h in the housing in order to load the specimen, and wherein the specimen serves as a road to have the black ice generated thereon; and one or more strap loading parts formed with recesses of a depth D1 downwards from a base of the depression and a depth D2 respectively from a first side surface of the depression and a second side surface thereof facing the first side surface, wherein the recesses are to accommodate one or more straps used for lifting the specimen in order to remove it from the specimen loading part after a generation of the black ice is completed, and wherein the depth D1 and the depth D2 are larger than a size of a cross-section of the straps.

As one example, the strap loading parts have two recesses, formed downwards from the base of the depression, with a width w, which is larger than the size of the cross-section of the straps, to thereby allow the specimen to be loaded without being unleveled due to the straps pre-loaded into the strap loading parts.

As one example, the strap loading parts have the depth D2, which is larger than the size of the cross-section of the straps, respectively from a third side surface of the depression and a fourth side surface thereof facing the third side surface, and wherein the strap loading parts have another two recesses, formed downwards from the base of the depression, with the width w, which is larger than the size of the cross-section of the straps, to thereby allow the specimen to be loaded without being unleveled due to the straps pre-loaded into the strap loading parts.

As one example, to allow the height h of the water layer to be recognized and allow a degree of minute adjustment therefrom to be recognized, at least part of the first side surface or the second side surface of the depression has (i) a coating of thermochromic dye, whose color is varied according to a temperature of the water layer, and (ii) a graduation respectively, and wherein the water layer represents a layer in a liquid state inserted onto the specimen held in the specimen loading part before the water layer on the specimen freezes to become the black ice.

As one example, at least part of the first side surface of the depression, the second side surface of the depression, the base of the depression, and an exterior of the black ice generating device are manufactured using a matte material in order to prevent an adverse effect due to a reflection of infrared rays.

As one example, the recesses of the strap loading parts have (i) a width w1 on (i-1) a surface of the base of the depression, (i-2) a surface of the first side surface of the depression, and (i-3) a surface of the second side surface of the depression, (ii) a width w2 at the depth D1 from the base of the depression and (iii) a width w3 respectively at the depth D2 from the first side surface of the depression and at the depth D2 from the second side surface of the depression, wherein the width w1, the width w2, and the width w3 are larger than the size of the cross-section of the straps.

As one example, there is provided an experimental method including steps of: (a) (i) loading the straps into the strap loading parts of the black ice generating device, (ii) loading the specimen into the specimen loading part of the black ice generating device, and (iii) pouring water onto the specimen in the specimen loading part such that a height of the water layer corresponds to a specific height; (b) on condition that the black ice generating device has been set up in a complex climate chamber in which a temperature level and a humidity level are controllable, cooling the specimen by maintaining the temperature level in the complex climate chamber to be a first temperature for a specific time t; (c) maintaining the humidity level in the complex climate chamber to be a first humidity in order to reproduce a precipitation environment, and maintaining the height of the water layer to be the specific height; and (d) (i) maintaining the temperature level in the complex climate chamber to be a second temperature for the specific time t to thereby allow a change of state on the specimen to be detected, (ii) obtaining information on a target temperature which represents a temperature at a time when the water layer begins to change into the black ice, and (iii) while the target temperature is maintained, changing the humidity level in the complex climate chamber from the first humidity to a second humidity, to thereby allow a change of state on the specimen and the height of the water layer or that of the black ice to be observed.

As one example, the first temperature is 5 degrees Celsius, and the second temperature is −5 degrees Celsius, and wherein the first humidity is 90% RH, and the second humidity is 30% RH.

As one example, the specific time t is 20 minutes, and the height of the water layer is 1-5 mm.

BRIEF DESCRIPTION OF THE DRAWINGS

The above and other objects and features of the present disclosure will become apparent from the following description of preferred embodiments given in conjunction with the accompanying drawings. The accompanying drawings used to explain example embodiments of the present disclosure are only part of example embodiments of the present disclosure and other drawings can be obtained based on the drawings by those skilled in the art of the present disclosure without inventive work.

DETAILED DESCRIPTION OF THE PREFERRED EMBODIMENTS

Figure 1:
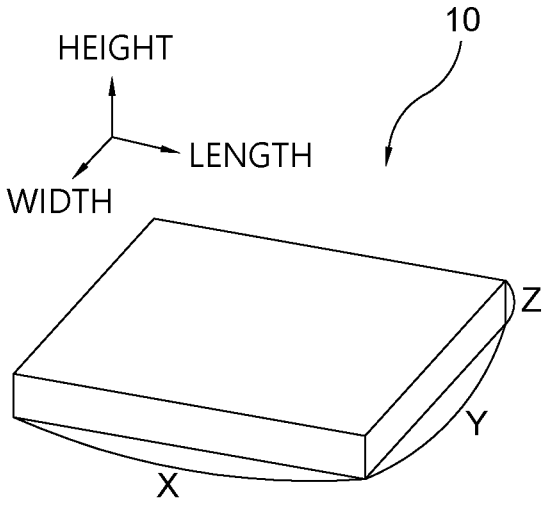
FIG. 1 illustrates a perspective view of a specimen with dimensions of a length X, a width Y, and a height Z in accordance with one example embodiment of the present disclosure.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the present invention, although different, are not necessarily mutually exclusive. For example, a particular feature, structure, or characteristic described herein in connection with one embodiment may be implemented within other embodiments without departing from the spirit and scope of the present invention. In addition, it is to be understood that the position or arrangement of individual elements within each disclosed embodiment may be modified without departing from the spirit and scope of the present invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

To allow those skilled in the art to carry out the present invention easily, the example embodiments of the present invention by referring to attached diagrams will be explained in detail as shown below.

FIG. 1 illustrates a perspective view of a specimen with dimensions of a length X, a width Y, and a height Z.

The specimen 10 serves as a road to have black ice generated thereon and it may be made of asphalt to reproduce a road-like quality, but it is not limited thereto.

Figure 2:
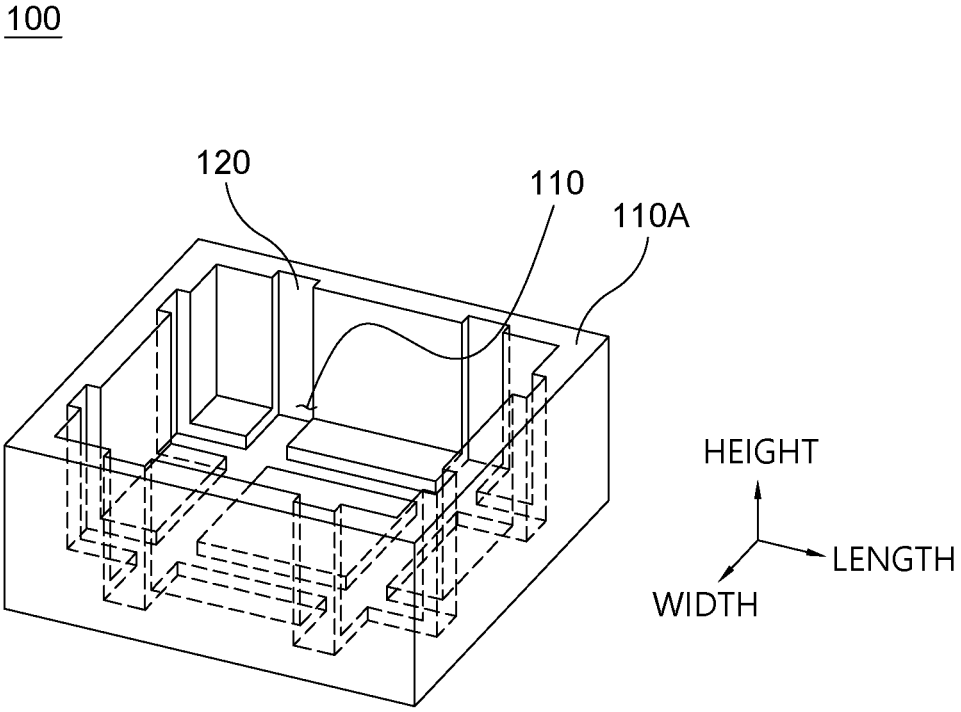
FIG. 2 illustrates a perspective view of a black ice generating device in accordance with one example embodiment of the present disclosure.
Figure 3:
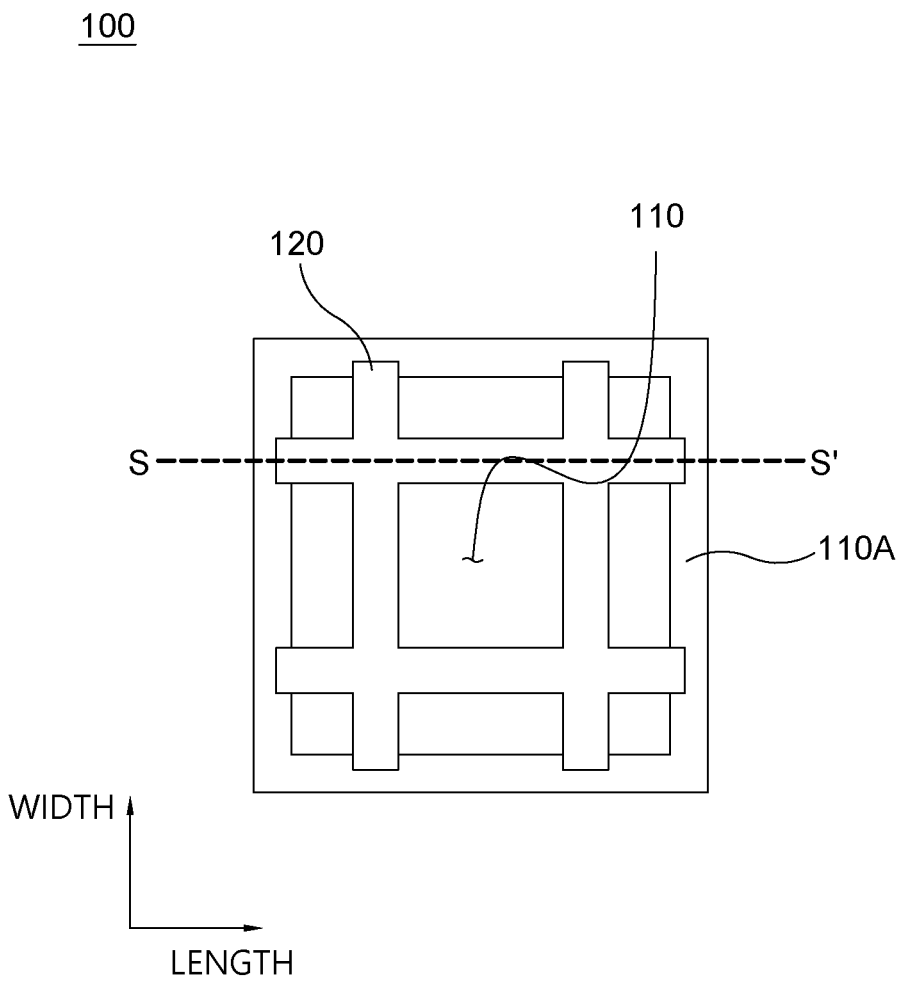
FIG. 3 illustrates a top plan view of a black ice generating device in accordance with one example embodiment of the present disclosure.

FIG. 2 and FIG. 3 are respectively a perspective view and a top plan view of the black ice generating device in accordance with one example embodiment of the present disclosure.

Referring to FIG. 2 and FIG. 3, the black ice generating device 100 for generating the black ice with a height h on the specimen 10, which has dimensions of length X, width Y, and height Z, to be used for experiments on the black ice, may include a specimen loading part 110, configured as a depression in a housing 110A, to load the specimen 10 thereinto. Herein, to generate the black ice on the specimen 10 to be used for experiments on the black ice, a water layer should be formed on top of the specimen 10, and therefore, the specimen 10 is loaded into the depression and then water is poured onto the specimen 10 to thereby generate the water layer. The specimen loading part 110 is made to be waterproof to prevent damage to the specimen loading part 110 when water is poured into the depression.

In detail, since it is necessary to load the specimen 10 into the depression, the depression should have dimensions of at least the length X and at least the width Y, and since it is also necessary to create the water layer with height h onto the specimen 10 with the height Z, the depression should have at least a height Z+h.

Subsequently, a configuration of strap loading parts 120 will be explained in detail with reference to FIG. 4.

Figure 4:
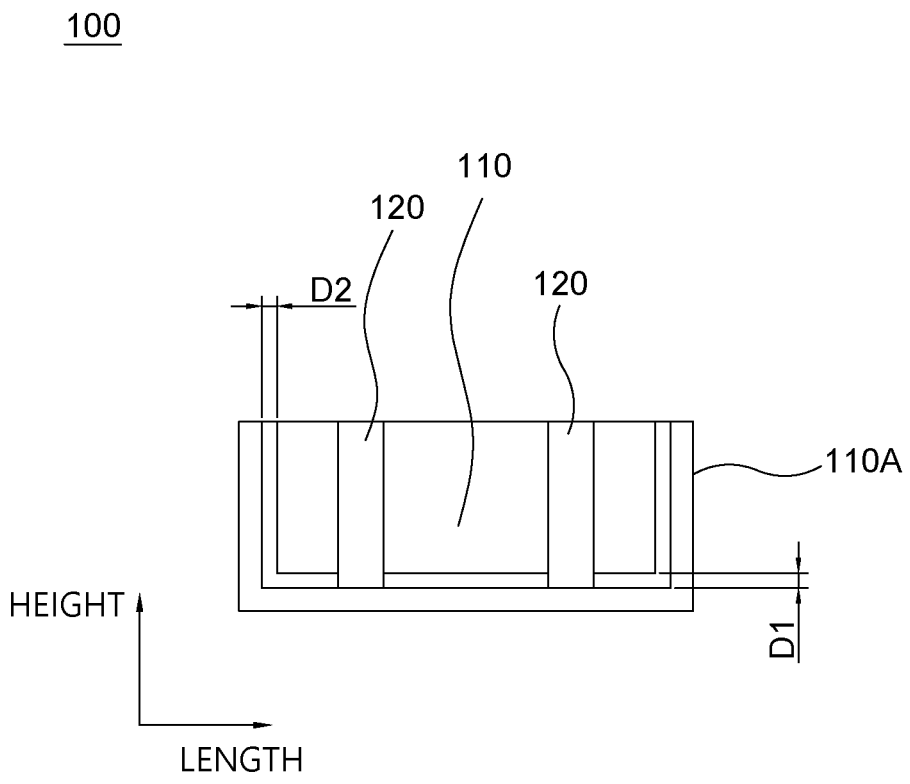
FIG. 4 illustrates a front cross-sectional view acquired by cutting the black ice generating device along a plane S-S' in accordance with one example embodiment of the present disclosure.

FIG. 4 illustrates a front cross-sectional view acquired by cutting the black ice generating device along a plane S-S' in accordance with one example embodiment of the present disclosure.

Figure 5:
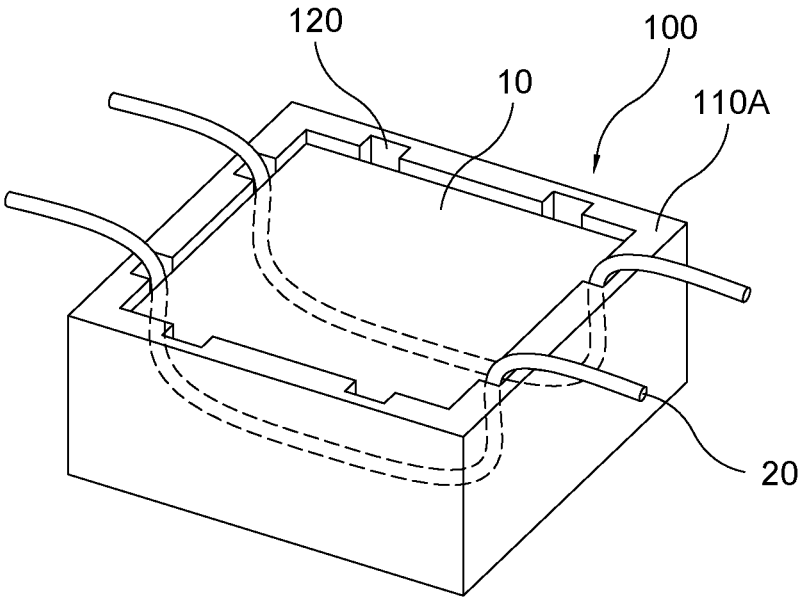
FIG. 5 illustrates the black ice generating device with straps and the specimen already-loaded thereinto in accordance with one example embodiment of the present disclosure.

The black ice generating device 100 may include one or more strap loading parts 120 formed with recesses of depth D1 downwards from a base of the depression and a depth D2 respectively from a first side surface of the depression and a second side surface thereof facing the first side surface to thereby accommodate straps 20 (as shown in FIG. 5). Herein, a cross-section of the straps 20 may be shapes of circles, triangles, or rectangles with certain sizes, but they are not limited thereto. Additionally, the depth D1 and the depth D2 may be larger than a size of the cross-section of the straps 20.

As one example embodiment, the black ice generating device 100 may be shaped as a cuboid with dimensions of length 42.5 cm, width 42.5 cm, and height 8 cm; and the specimen 10 may be shaped as a cuboid with dimensions of length 40 cm, width 40 cm, and height 6 cm. With such dimensions for the black ice generating device 100 and the specimen 10, the depression may be formed with dimensions of length 40.5 cm, width 40.5 cm, and height 7 cm.

Subsequently, the loading configuration of the black ice generating device 100 will be explained by referring to FIG. 5.

FIG. 5 illustrates the specimen 10 and the straps 20 loaded into the black ice generating device 100 in accordance with one example embodiment of the present disclosure.

Herein, the strap loading parts 120 may be configured as at least two recesses. Each of the recesses has (i) the depth D1, which is larger than the size of the cross-section of the straps 20, downwards from the base of the depression of the specimen loading part 110, (ii) the depth D2, which is larger than the size of the cross-section of the straps 20, respectively from the first side surface of the depression of the specimen loading part 110, and the second side surface thereof facing the first side surface, and (iii) a width w, which is larger than the size of the cross-section of the straps 20, (i) on the base of the depression, (ii) on the first side surface of the depression and (iii) on the second side surface of the depression, to thereby allow the specimen 10 to be loaded without being unleveled due to the straps pre-loaded into the strap loading parts 120.

If at least one of the depth D1, the depth D2, and width w is assumed to be smaller than the size of the cross-section of the straps 20, the straps 20 may outwardly protrude from the strap loading parts 120, which may cause the specimen 10 to be unleveled due to the outwardly protruding said straps 20. If the specimen 10 is unleveled, then it becomes difficult to level the height h of the water layer to be maintained on the specimen 10. Therefore, the depth D1, the depth D2, and the width w should be larger than the size of the cross-section of the straps 20. Herein, if the shapes of the cross-section of the straps 20 are not circles, then the depth D1, the depth D2, and the width w can be changed to accommodate the shapes of the cross-section of the straps 20. For instance, if the shapes of the cross-section of the straps 20 are rectangular, then the depth D1, the depth D2, and the width w may be large enough to accommodate a corner of such shapes.

Further, the strap loading parts 120 may be further configured as another two recesses. Each of said another two recesses has (i) the depth D1, which is larger than the size of the cross-section of the straps 20, downwards from the base of the depression of the specimen loading part 110, (ii) the depth D2, which is larger than the size of the cross-section of the straps 20, respectively from a third side surface of the depression of the specimen loading part 110 and a fourth side surface thereof facing the third side surface, and (iii) a width w, which is larger than the size of the cross-section of the straps 20, (i) on the base of the depression, (ii) on the third side surface of the depression and (iii) on the fourth side surface of the depression, to thereby allow the specimen 10 to be loaded without being unleveled due to the straps pre-loaded into the strap loading parts 120.

Herein, the third side surface and the fourth side surface facing each other may be different from the first side surface and the second side surface facing each other. In addition, said another two recesses serving as the strap loading parts 120 may be formed on the third side surface and the fourth side surface even when the two recesses serving as the strap loading parts 120 are formed. That is, there may be a total of 4 strap loading parts 120, but the number of the strap loading parts 120 is not limited thereto.

As another example, the strap loading parts 120 may be configured as recesses having (i) a width w1 on (i-1) a surface of the base of the depression, (i-2) a surface of the first side surface of the depression, and (i-2) a surface of the second side surface of the depression, (ii) a width w2 at the depth D1 from the base of the depression and (iii) a width w3 respectively at the depth D2 from the first side surface of the depression, and at the depth D2 from the second side surface of the depression, herein, the width w1, the width w2, and the width w3 are larger than the size of the cross-section of the straps 20.

In simple terms, the strap loading parts 120 can have widths such that (i) the widths on a surface of the base of the depression can be different from the widths at the depth D1 from the base of the depression, and (ii) the widths on the surface of the first side surface of the depression and the surface of the second side surface of the depression can be different from the widths at the depth D2 from the first side surface of the depression and at the depth D2 from the second side surface of the depression. That is, a cross-section of the recesses can be shaped as a trapezoid.

Additionally, to allow the height h of the water layer to be recognized and allow a degree of minute adjustment therefrom to be recognized, at least part of the first side surface and the second side surface of the depression has (i) a coating of thermochromic dye, whose color is varied according to a temperature of the water layer, and (ii) a graduation respectively.

Herein, the water layer represents a layer in a liquid state inserted onto the specimen 10 held in the specimen loading part 110. Further, there may be a coating of the thermochromic dye on where the graduation is made, to thereby allow a height of the water layer to be intuitively recognized by using a change in the color on the graduation.

Moreover, at least part of the first side surface of the depression, the second side surface of the depression, the base of the depression, and an exterior and/or an interior of the housing 110A may be manufactured by using matte material in order to prevent an adverse effect due to a reflection of infrared rays.

As one example embodiment, the matte material may be matte black acrylic. If the matte black acrylic is used, waterproof effect and prevention of the adverse effect due to the reflection of the infrared rays can be achieved at the same time. The reason for a use of such matte material is to allow a surface condition, e.g., a surface temperature, of the specimen 10 and the height h of the water layer to be observed by using the infrared rays. If other materials, which may allow the reflection of the infrared rays, are used, the infrared rays will be reflected, and the adverse effect of inaccurate data readings on the surface temperature of the specimen 10 and the height h of water layer may occur.

One example experimental method by using the aforementioned black ice generating device is explained below.

First, (i) the straps 20 are loaded into the strap loading parts 120 of the black ice generating device 100, (ii) the specimen 10 is loaded into the specimen loading part 110 of the black ice generating device 100 and (iii) water is poured onto the specimen 10 in the specimen loading part 110 such that a height of the water layer corresponds to a specific height.

Herein, the specific height may be 1-5 mm.

Next, on condition that the black ice generating device has been set up in a complex climate chamber in which a temperature level and a humidity level are controllable, the specimen 10 is cooled by maintaining the temperature level in the complex climate chamber to be a first temperature for a specific time t.

Herein, the first temperature may be 5 degree Celsius, and the specific time may be 20 minutes. This is to reproduce an environment of a road before precipitation.

Afterwards, the humidity level in the complex climate chamber is maintained to be a first humidity in order to reproduce a precipitation environment, and the height of the water layer is maintained to be the specific height.

Same as above, the specific height may be 1-5 mm, and the first humidity may be 90% RH to reproduce the precipitation environment.

Thereafter, the temperature level in the complex climate chamber is maintained to be a second temperature for the specific time t to thereby allow a change of state on the specimen 10 to be detected, and obtain information on a target temperature which represents a temperature at a time when the water layer begins to change into the black ice, and (iii) while the target temperature is maintained, the humidity level in the complex climate chamber is changed from the first humidity to a second humidity, to thereby allow a change of state on the specimen and the height of the water layer or that of the black ice to be observed.

Herein, the second temperature may be −5 degree Celsius in order to satisfy a freezing condition and the second humidity may be 30% RH.

Finally, the specimen 10 on which the black ice is generated may be removed by allowing the straps 20 to be lifted, and the specimen 10 may be used for the experiments on the black ice.

The present disclosure has an effect of greatly reducing time and labor consumed when generating the black ice.

The present disclosure has another effect of providing the black ice generating device including the specimen loading part, configured as the depression in the housing, and one or more strap loading parts, configured as recesses for loading one or more straps.

The present disclosure has still another effect of allowing the height of the water layer to be recognized and allowing the degree of minute adjustment therefrom to be recognized by coating thermochromic dye, whose color is varied according to a temperature of a water layer, and graduating at least part of a first side surface and a second side surface of the depression.

As seen above, the present disclosure has been explained by specific matters such as detailed components, limited embodiments, and drawings. While the invention has been shown and described with respect to the preferred embodiments, it, however, will be understood by those skilled in the art that various changes and modification may be made without departing from the spirit and scope of the invention as defined in the following claims.

Accordingly, the thought of the present disclosure must not be confined to the explained embodiments, and the following patent claims as well as everything including variations equal or equivalent to the patent claims pertain to the category of the thought of the present disclosure.

What is claimed is:

1. A black ice generating device for generating black ice on a specimen, with dimensions of length X, width Y, and height Z, to be used for experiments on black ice, comprising:

a housing;

a specimen loading part, made to be waterproof, for accommodating at least a height h of a water layer to be used for generating the black ice therein, wherein the specimen loading part is configured as a depression with dimensions of at least length X, at least width Y, and at least height Z+h in the housing in order to load the specimen, and wherein the specimen serves as a road to have the black ice generated thereon; and one or more strap loading parts formed with recesses of a depth D1 downwards from a base of the depression and a depth D2 respectively from a first side surface of the depression and a second side surface thereof facing the first side surface, wherein the recesses are to accommodate one or more straps used for lifting the specimen in order to remove it from the specimen loading part after a generation of the black ice is completed, and wherein the depth D1 and the depth D2 are larger than a size of a cross-section of the straps.

2. The black ice generating device of claim 1, wherein the strap loading parts have two recesses, formed downwards from the base of the depression, with a width w, which is larger than the size of the cross-section of the straps, to thereby allow the specimen to be loaded without being unleveled due to the straps pre-loaded into the strap loading parts.

3. The black ice generating device of claim 2, wherein the strap loading parts have the depth D2, which is larger than the size of the cross-section of the straps, respectively from a third side surface of the depression and a fourth side surface thereof facing the third side surface, and wherein the strap loading parts have another two recesses, formed downwards from the base of the depression, with the width w larger than the size of the cross-section of the straps, to thereby allow the specimen to be loaded without being unleveled due to the straps pre-loaded into the strap loading parts.

4. The black ice generating device of claim 1, wherein, to allow the height h of the water layer to be recognized and allow a degree of minute adjustment therefrom to be recognized, at least part of the first side surface and the second side surface of the depression has (i) a coating of thermochromic dye, whose color is varied according to a temperature of the water layer, and (ii) a graduation respectively, and wherein the water layer represents a layer in a liquid state inserted onto the specimen held in the specimen loading part before the water layer on the specimen freezes to become the black ice.

5. The black ice generating device of claim 1, wherein at least part of the first side surface of the depression, the second side surface of the depression, the base of the depression, and an exterior of the housing are manufactured using a matte material in order to prevent an adverse effect due to a reflection of infrared rays.

6. The black ice generating device of claim 1, wherein the recesses of the strap loading parts have (i) a width w1 on (i-1) a surface of the base of the depression, (i-2) a surface of the first side surface of the depression, and (i-3) a surface of the second side surface of the depression, (ii) a width w2 at the depth D1 from the base of the depression and (iii) a width w3 respectively at the depth D2 from the first side surface of the depression and at the depth D2 from the second side surface of the depression, wherein the width w1, the width w2, and the width w3 are larger than the size of the cross-section of the straps.

7. An experimental method for using the black ice generating device according to any of claims 1-6, comprising steps of:

(a) (i) loading the straps into the strap loading parts of the black ice generating device, (ii) loading the specimen into the specimen loading part of the black ice generating device, and (iii) pouring water onto the specimen in the specimen loading part such that a height of the water layer corresponds to a specific height;

(b) on condition that the black ice generating device has been set up in a complex climate chamber in which a temperature level and a humidity level are controllable, cooling the specimen by maintaining the temperature level in the complex climate chamber to be a first temperature for a specific time t;

(c) maintaining the humidity level in the complex climate chamber to be a first humidity in order to reproduce a precipitation environment, and maintaining the height of the water layer to be the specific height; and (d) (i) maintaining the temperature level in the complex climate chamber to be a second temperature for the specific time t to thereby allow a change of state on the specimen to be detected, (ii) obtaining information on a target temperature which represents a temperature at a time when the water layer begins to change into the black ice, and (iii) while the target temperature is maintained, changing the humidity level in the complex climate chamber from the first humidity to a second humidity, to thereby allow a change of state on the specimen and the height of the water layer or that of the black ice to be observed.

8. The experimental method of claim 7, wherein the first temperature is 5 degrees Celsius, and the second temperature is −5 degrees Celsius, and wherein the first humidity is 90% RH, and the second humidity is 30% RH.

9. The experimental method of claim 7, wherein the specific time t is 20 minutes, and the specific height is 1-5 mm.

* * * * *